US009493282B2

(12) United States Patent
Nielsen

(10) Patent No.: US 9,493,282 B2
(45) Date of Patent: Nov. 15, 2016

(54) CONDIMENT CONTAINER ATTACHMENT DEVICE

(76) Inventor: Charlotte Nielsen, Højbjerg (DK)

( * ) Notice: Subject to any disclaimer, the term of this patent is extended or adjusted under 35 U.S.C. 154(b) by 0 days.

(21) Appl. No.: 13/143,106

(22) PCT Filed: Dec. 23, 2009

(86) PCT No.: PCT/DK2009/050354

§ 371 (c)(1),
(2), (4) Date: Jul. 27, 2011

(87) PCT Pub. No.: WO2010/075859

PCT Pub. Date: Jul. 8, 2010

(65) Prior Publication Data

US 2011/0272546 A1 Nov. 10, 2011

(30) Foreign Application Priority Data

Jan. 2, 2009 (DK) ..... 2009 00007

(51) Int. Cl.

| | |
|---|---|
| ***B65D 51/28*** | (2006.01) |
| ***A47G 19/04*** | (2006.01) |
| ***B65D 25/20*** | (2006.01) |
| ***B65D 25/22*** | (2006.01) |

(52) U.S. Cl.

CPC ..... *B65D 51/28* (2013.01); *A47G 19/04* (2013.01); *B65D 25/20* (2013.01); *B65D 25/22* (2013.01); *B65D 2543/00046* (2013.01); *B65D 2543/00092* (2013.01)

(58) Field of Classification Search

CPC ..... A47G 23/0216; A47G 23/02; A47G 19/2205; A47G 19/2272; A47J 47/16; B65D 2543/00092; B65D 2543/00096; B65D 2543/00296; B65D 2543/00509

USPC ..... 220/23.4, 694, 521, 4.03, 23.83, 711, 220/23.86, 737; 248/223.41, 220.21, 316.7, 248/316.1, 311.2, 312.1, 314; 206/217, 528

See application file for complete search history.

(56) References Cited

U.S. PATENT DOCUMENTS

| | | | | |
|---|---|---|---|---|
| 2,161,577 | A * | 6/1939 | Howlett | 15/263 |
| 2,748,977 | A * | 6/1956 | Sarchet | 220/697 |
| 3,300,168 | A * | 1/1967 | Gaudino | 248/227.2 |
| 3,432,875 | A * | 3/1969 | Edelson et al. | 15/246 |
| 4,561,556 | A * | 12/1985 | Bendix | 220/697 |
| 4,757,568 | A * | 7/1988 | Jones | 15/105 |
| 4,854,470 | A * | 8/1989 | Ireland | 220/697 |

(Continued)

OTHER PUBLICATIONS

International Search Report for PCT/DK2009/050354 dated May 3, 2010.

*Primary Examiner* — Nkeisha Smith
(74) *Attorney, Agent, or Firm* — Adam J. Cermak; Cermak Nakajima & McGowan LLP

(57) ABSTRACT

A condiment container attachment device (1) for attaching a condiment container (50) to a food or a beverage container (100), the container (100) being of a type having—an upwardly facing opening (110); —at least one inwardly facing first surface (140, 240); and—a bead (130) or downwardly facing skirt (230) encircling said opening (110), said bead or skirt having an inwardly facing second surface (131, 231) and a downwardly facing edge (132, 232) said condiment container attachment device (1) comprising—first attachment means (10) adapted for engagement with said inwardly facing first surface (140, 240) of the food or beverage container (100); and—second attachment means (20) adapted for engagement with said bead (130) or downwardly facing skirt (230).

10 Claims, 7 Drawing Sheets

(56) References Cited

U.S. PATENT DOCUMENTS

| | | | | |
|---|---|---|---|---|
| 5,038,955 | A * | 8/1991 | Studer et al. | 220/736 |
| 5,085,386 | A * | 2/1992 | Hicks et al. | 248/110 |
| 5,687,873 | A * | 11/1997 | Jones | 220/736 |
| 5,722,558 | A * | 3/1998 | Thompson | 220/521 |
| 6,056,253 | A * | 5/2000 | Tripp | 248/213.2 |
| 6,209,748 | B1 | 4/2001 | Dunbar | |
| 6,394,297 | B1 * | 5/2002 | Nance | 220/23.4 |
| 6,401,927 | B1 * | 6/2002 | Sorensen et al. | 206/562 |
| 6,682,034 | B1 * | 1/2004 | Vial | 248/231.81 |
| 6,755,305 | B2 * | 6/2004 | Nance | 206/519 |
| 7,922,022 | B2 * | 4/2011 | Ciarrocchi, Jr. | 220/23.4 |
| 7,980,406 | B2 * | 7/2011 | Liu | 220/23.4 |
| 2001/0050283 | A1 * | 12/2001 | Nance | 220/482 |
| 2004/0182862 | A1 * | 9/2004 | Scott | 220/212 |
| 2007/0000922 | A1 | 1/2007 | Vovan et al. | |
| 2007/0205199 | A1 * | 9/2007 | Wothers | 220/506 |
| 2007/0241105 | A1 * | 10/2007 | Nielsen | 220/23.4 |
| 2008/0290089 | A1 | 11/2008 | Ciarrocchi, Jr. | |
| 2010/0102183 | A1 * | 4/2010 | Arkin | 248/208 |
| 2011/0309096 | A1 * | 12/2011 | Jones | 220/737 |

* cited by examiner

CONDIMENT CONTAINER ATTACHMENT DEVICE

CROSS REFERENCE TO RELATED APPLICATIONS

This application claims the benefit and priority to and is a U.S. National Phase Application of PCT International Application Number PCT/DK2009/050354, filed on Dec. 23, 2009, designating the United States of America and published in the English language, which is an International Application of and claims the benefit of priority to Danish Patent Application No. PA 2009 00007, filed on Jan. 2, 2009. The disclosures of the above-referenced applications are hereby expressly incorporated by reference in their entireties.

FIELD OF THE INVENTION

The present invention relates to a condiment container attachment device for attachment of a condiment container to a food or beverage container.

The invention further relates to a condiment container attachment device adapted to the field of fast-food packaging and containers, such as disposable condiment containers intended for use with a conventional disposable beverage container such as a beverage container with a cover.

BACKGROUND OF THE INVENTION

Currently in today's fast paced society, food is often consumed on the go. Fast food restaurants profit through their ability to create food for the public that is both filling and can be prepared and consumed at an accelerated pace. The majority of such eating establishments offer drive through services where the consumer can order, pay for and then consume their food while never leaving their vehicle. This creates a problem for the consumer by having to both eat and drink while driving. Most fast food meals typically contain a main dish, such as a sandwich, a secondary dish, such as french fries or onion rings, and a beverage. Often, the secondary meal is accompanied with a condiment. The condiments range from ketchup to ranch style dressing and are intended for use with e.g. the fries or onion rings. Consumers are confronted with the problem of organizing their meal in such a way that they can eat and also drive safely, or when consuming the meal standing. As such, the organizational problem of the consumer is increased when the consumer desires to dip e.g. their fries or onion rings into the condiment.

A solution to this problem is to provide a condiment container that has the ability to attach itself to a food or beverage container such as the box of fries or beverage container. Prior art containers have been designed to achieve this solution but their design and functionality do not accomplish a satisfactory result.

For example, U.S. Pat. No. 6,394,297 to Nance describes the idea of attaching a secondary condiment container with a prong to an associated food container such as a french fries box. This design does not solve the problem of allowing the consumer to drive safely while dipping their food in the condiment container. In a vehicle, there are typically storage compartments to place beverages while driving. However, there are no convenient areas to place in a fixed upright position the french fries box. As such, the consumer still does not have the ability to conveniently use the condiment with the meal. U.S. Pat. No. 6,427,864 to Asselin discloses a condiment container that surrounds the drinking straw of the beverage container. While this does allow for the consumer to have the condiment fixed to a container which is situated in a cup holder of the vehicle, such condiment container is not optimal. The container requires that the consumer dip around the straw, thereby having the straw as an obstacle in the dipping process. Further, the surface area is minimal and the amount of condiment which can be successfully used is hindered. Other prior art discloses condiment container attached to food or beverage containers as well. WO 94/13180 discloses a system for attachment of a condiment container, where either the food or beverage container that the condiment container is to be attached to needs to be specially designed, or where the condiment container is only loosely or unsafely attached to the food or beverage container, or where the attached condiment container impedes access to the food or beverage container. WO2004/086919 discloses a system where a condiment container is attached to the drinking straw of a beverage container which provides a loosely or unsafely attached condiment container. The same can be said for the condiment container disclosed in U.S. Pat. No. 4,854,466.

Hence an improved condiment container attachment device would be advantageous, and in particular a more efficient and or reliable condiment container attachment device that may be stably secured to a food or beverage container without impeding the access to the food or beverage container and/or to the condiment container would be advantageous.

OBJECT OF THE INVENTION

An object of the invention may be provide a more efficient and or reliable condiment container attachment device that may be stably secured to a food or beverage container without impeding the access to the food or beverage container and/or to the condiment container In particular, it may be seen as an object of the present invention to provide a condiment container attachment device that solves the above mentioned problems of the prior art.

It is a further object of the present invention to provide a condiment container attachment device that may be attached to standardized food or beverage containers.

It is a further object of the present invention to provide an alternative to the prior art

SUMMARY OF THE INVENTION

Thus, the above described object and several other objects are intended to be obtained in a first aspect of the invention by providing a condiment container attachment device for attaching a condiment container to a food or a beverage container, the container being of a type having

- an upwardly facing opening;
- at least one inwardly facing first surface; and
- a bead or downwardly facing skirt encircling said opening, said bead or skirt having an inwardly facing second surface and a downwardly facing edge said condiment container attachment device comprising

- first attachment means adapted for engagement with said inwardly facing first surface of the food or beverage container; and
- second attachment means adapted for engagement with said bead or downwardly facing skirt.

Devices embodying principles of the present invention thus can have many advantages over the prior art. Such devices can provide a disposable condiment container intended for use with a conventional food or beverage container or food or beverage container cover or lid. The access to the condiment container is unobstructed and has an ease of use, as it is attached to the food or beverage container or food or beverage container cover or lid via the first and second attachment means integral to the condiment container attachment device. This allows for the condiment container to be positioned on the side of the beverage rather than obstructed by or obstructing access to the top opening of the food or beverage container and/or a drinking straw. The first and second attachment means allows a stable and easy attachment to the food or beverage container.

The condiment container attachment device allows the second attachment means to be arranged to counteract a moment on said first attachment means. Thereby, the condiment container may be firmly and stably attached to the food or beverage container in order to avoid spillage or the condiment container accidentally being tilted or dislocated from the food or beverage container during use.

In an embodiment of the condiment container attachment device, the first attachment means may comprise a downwardly facing tap for engagement with said first surface. However other means for engaging with the first surface may be constructed of, e.g., flanges, bulges, strips etc.

The downwardly facing tap may be arranged on an inwardly facing first arm, the downwardly facing tap extending from said first arm.

The first surface with which the first attachment means is adapted to engage, may be an inner surface of said food or beverage container.

The above mentioned bead or downwardly facing skirt encircling said opening may be formed in said food or beverage container.

Alternatively or additionally, a first surface may be provided in a lid or cover for covering the opening of said food or beverage container. The inwardly facing first surface may then be formed in a groove formed in said lid.

The second attachment means may be a tap adapted for engagement with said inwardly facing second surface or said downwardly facing edge of said bead or downwardly facing skirt on said food or beverage container. The inwardly facing second surface and said downwardly facing edge may be formed on a downwardly facing peripheral skirt on a lid for said food or beverage container, where said second attachment means is a tap adapted for engagement with said inwardly facing second surface or said downwardly facing edge or downwardly facing skirt on said lid.

In one embodiment the second attachment means comprises an upwardly facing tap for engagement with said inwardly facing second surface. Then, the second attachment means may further comprises an inwardly facing second arm; said upwardly facing tap extending form said second arm.

In another embodiment the second attachment means comprises an inwardly facing tap for engagement with said downwardly facing edge. Then, the second attachment means ay further comprise a downwardly facing arm; said inwardly facing tap extending form said second arm.

In combination with all of the above mentioned embodiments the condiment container attachment device may further comprise holding means for receiving an attachable condiment container. Then the condiment container attachment device may further comprise snap means for releasably fixing said condiment container to said condiment container attachment device. In an embodiment hereof the second attachment means adapted for engagement with said inwardly facing second surface may be provided on an inwardly extending arm formed integral with and extending from said releasable condiment container. Then, the second attachment means may be a bulge provided on the inwardly extending arm on said releasable condiment container.

Alternatively, the condiment container may be formed integral with the condiment container attachment device.

In a further embodiment that may be combined with any of the above mentioned embodiments the condiment container attachment device may further comprises a third arm adapted for engagement with an outer surface of said food or beverage container. Then, the additional second attachment means may be formed on said third arm, e.g. in the form of a notch formed in said arm.

Another aspect of the invention involves an assembly comprising a food or beverage container in combination with a condiment container attachment device as described in all the above mentioned embodiments.

Throughout this document the terms "comprising" or "comprises" do not exclude other possible elements or steps. Also, the mentioning of references such as "a" or "an" etc. should not be construed as excluding a plurality.

Throughout this document the term condiment is used in the meaning a preparation (a sauce or relish or spice) to enhance flavor or enjoyment of a food or beverage, e.g. mustard and ketchup are condiments. Thus, a condiment in this context should be understood as a flavorer, flavoring, flavourer, flavouring, seasoner, or seasoning. Examples may further be: acetum, catsup, ketchup, chili sauce, chutney, cranberry sauce, dip, duck sauce, hoisin sauce, horseradish, Indian relish, ketchup, marinade, mint sauce, mustard, paste, relish, salsa, sauce, soy, soy sauce, spread, steak sauce, table mustard, taco sauce, tomato ketchup, vinegar, and wasabi.

BRIEF DESCRIPTION OF THE DRAWINGS

The condiment container attachment device according to the invention will now be described in more detail with regard to the accompanying figures. The figures show one way of implementing the present invention and is not to be construed as being limiting to other possible embodiments falling within the scope of the attached claim set.

EMBODIMENTS OF THE INVENTION

Figure 1A:
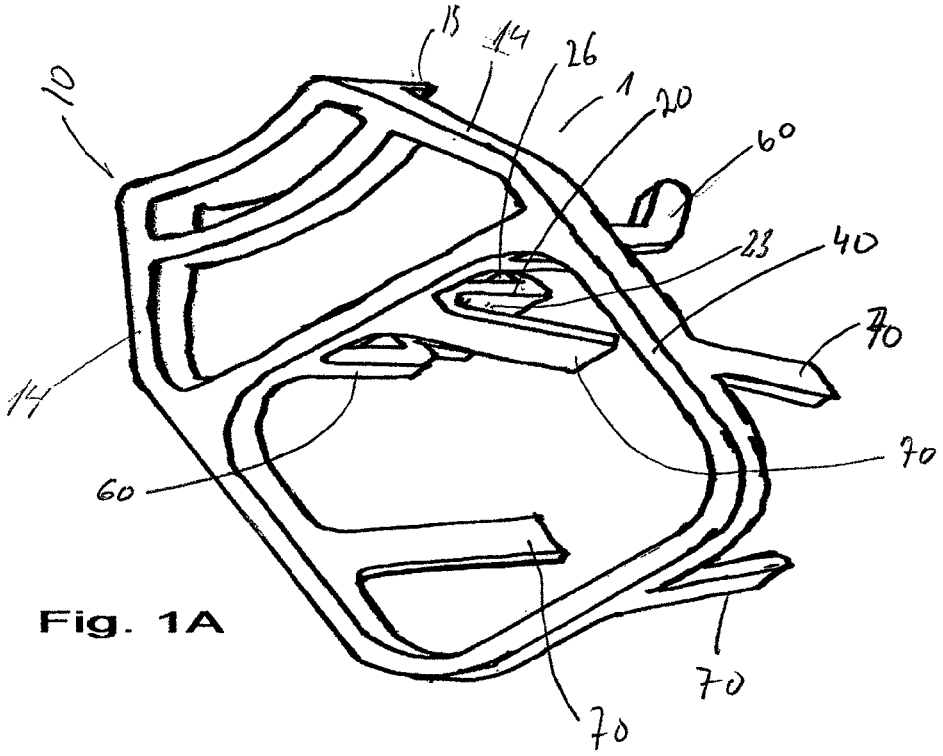
FIG. 1A, in a perspective view, shows a condiment container attachment device according to one embodiment of the invention.
Figure 1B:
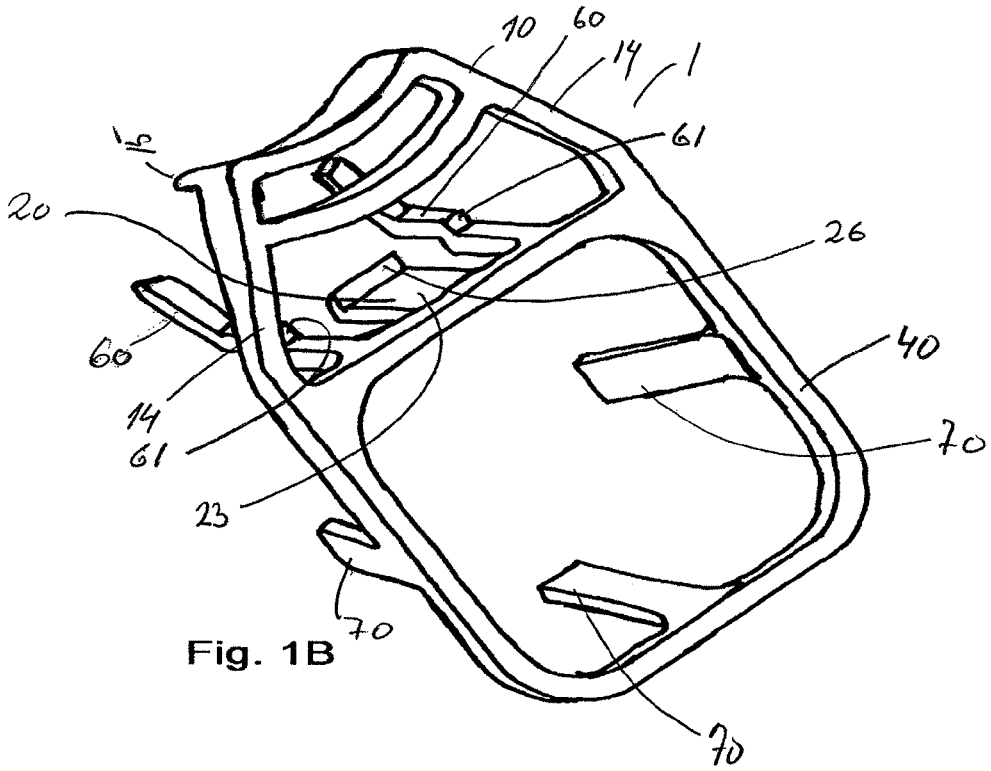
FIG. 1B, shows the condiment container attachment device of FIG. 1A in another perspective view.
Figure 1C:
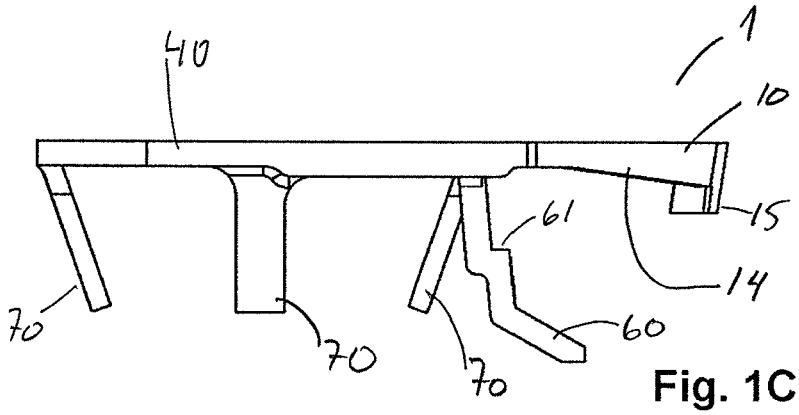
FIG. 1C shows a side view of the condiment container attachment device shown in FIG. 1A.
Figure 1D:
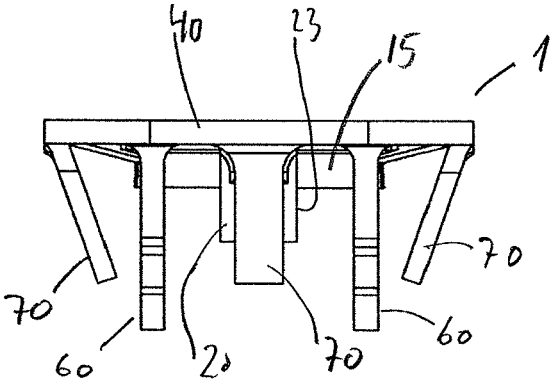
FIG. 1D shows a front view of the condiment container attachment device shown in FIG. 1A.
Figure 1E:
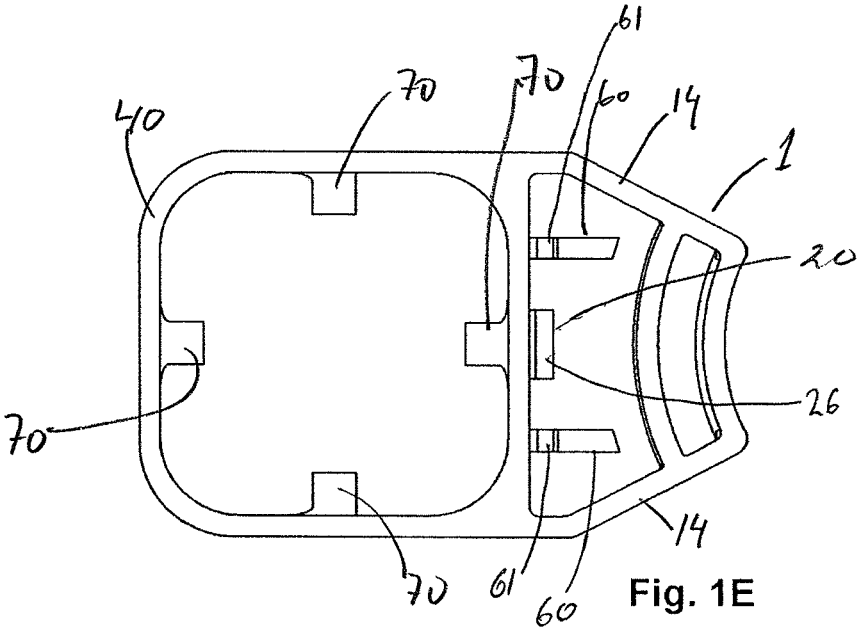
FIG. 1E shows a top view of the condiment container attachment device shown in FIG. 1A.
Figure 2A:
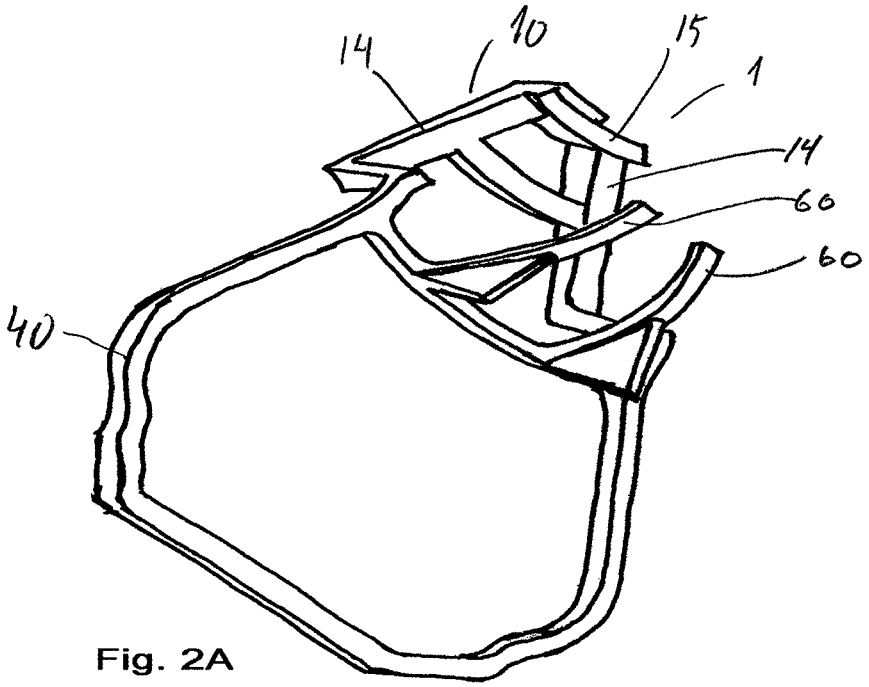
FIG. 2 shows a condiment container attachment device according to another embodiment of the invention adapted for attachment to a beverage or food container with a condiment container as shown in FIG. 3.
FIG. 2B, shows the condiment container attachment device of FIG. 2A in another perspective view.
FIG. 2C shows a top view of the condiment container attachment device shown in FIG. 2A.
FIG. 2D shows a side view of the condiment container attachment device shown in FIG. 2A.
FIG. 2E shows a front view of the condiment container attachment device shown in FIG. 2A.
Figure 2B:
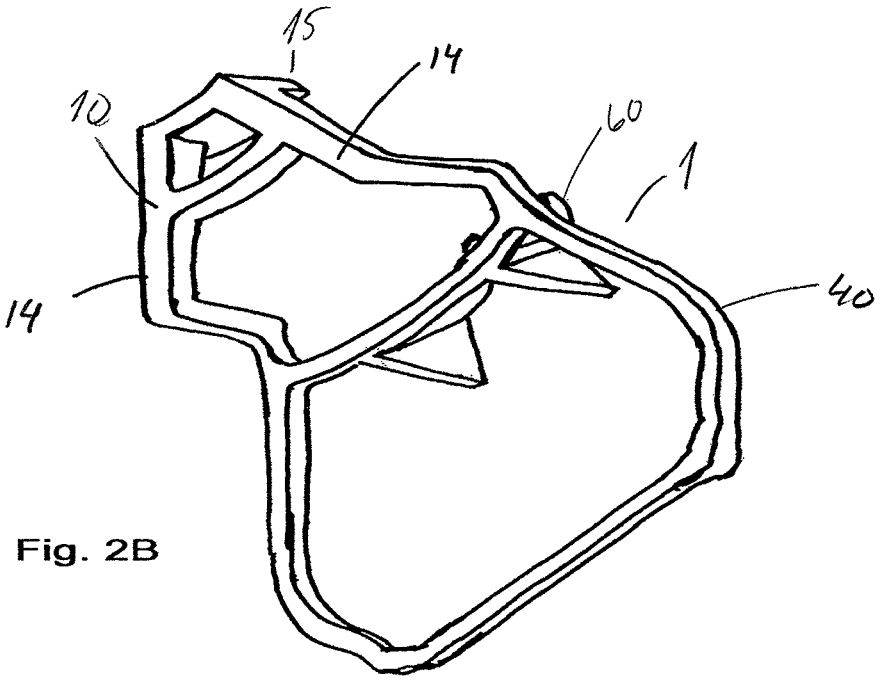
Figure 2C:
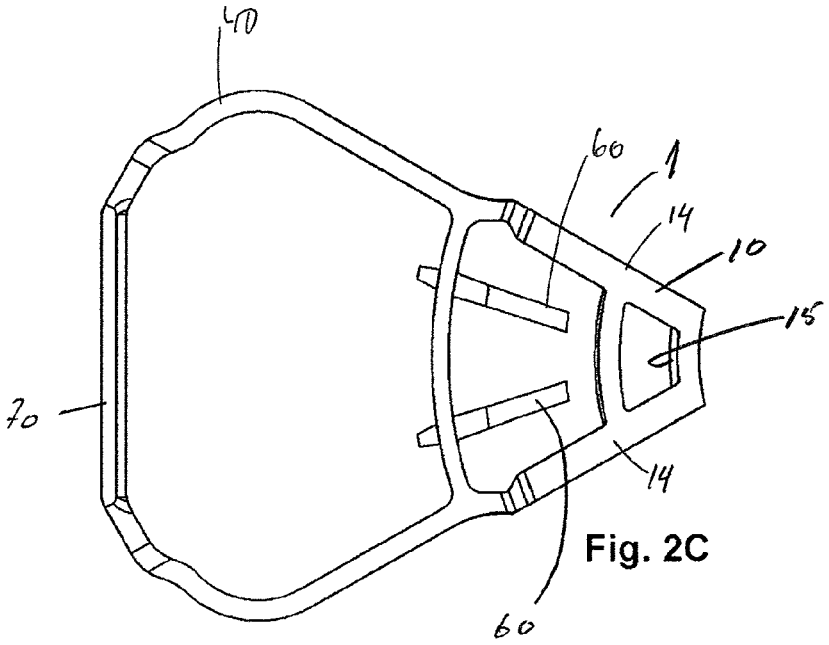
Figure 2D:
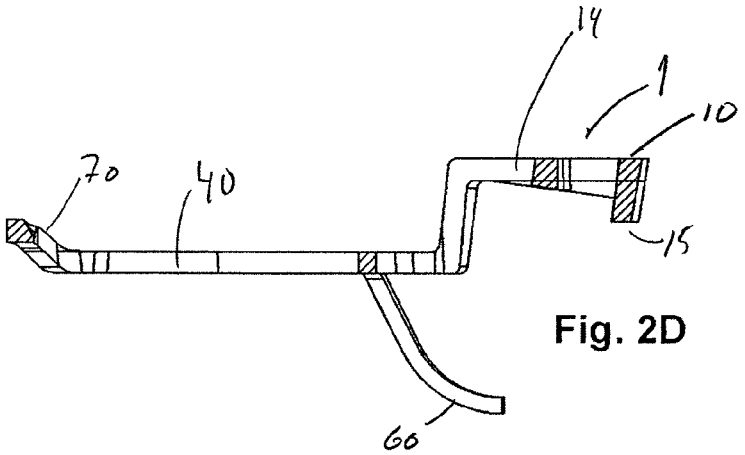
Figure 2E:
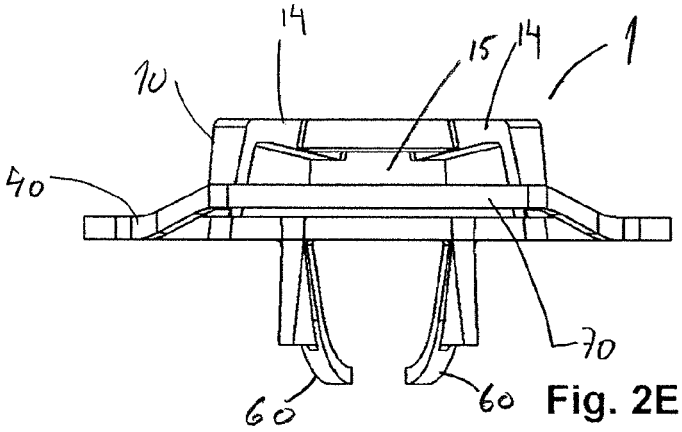

Referring to the drawing figures, like reference numerals designate identical or corresponding elements throughout the several figures.

Figure 4A:
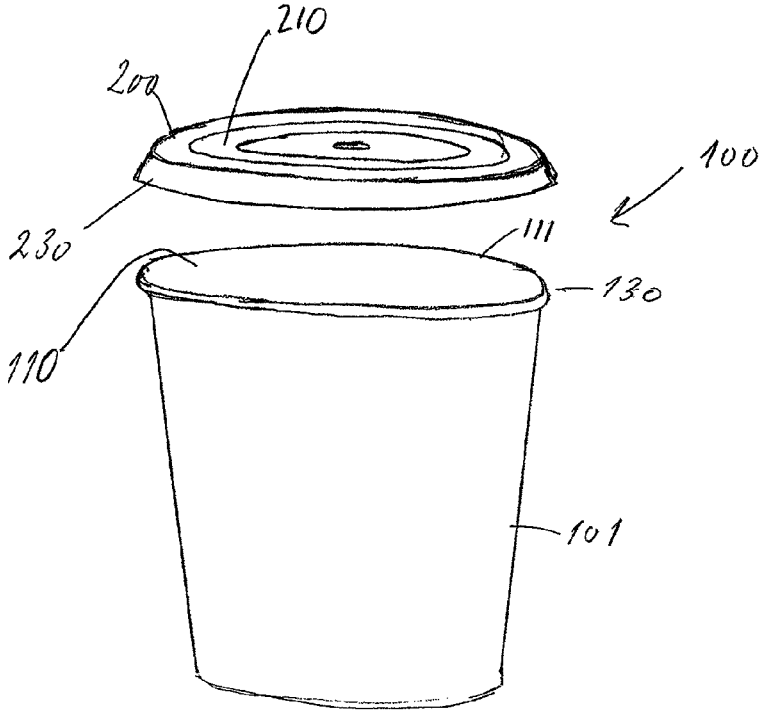
FIG. 4A, in a perspective view, shows a food or beverage container of the type having an upwardly facing opening encircled by an upwardly facing edge and having a bead and a lid with a downwardly facing skirt adapted for cooperation with said bead to form a closed container.

The invention relates to a condiment container attachment device 1 for attaching a condiment container 50 to a food or a beverage container 100, such as shown in FIGS. 4 and 5. The container 100 shown in these figures is a conventional type beverage container of the type typically used for beverages such as soft drinks at, e.g., fast food restaurants, having a container proper 101 and possibly a cover or lid 200. The container 100, 101, and lid 200 shown are cylindrical, but the devices described hereinafter may also work with other types of containers and lids with other cross sectional forms.

Figure 4B:
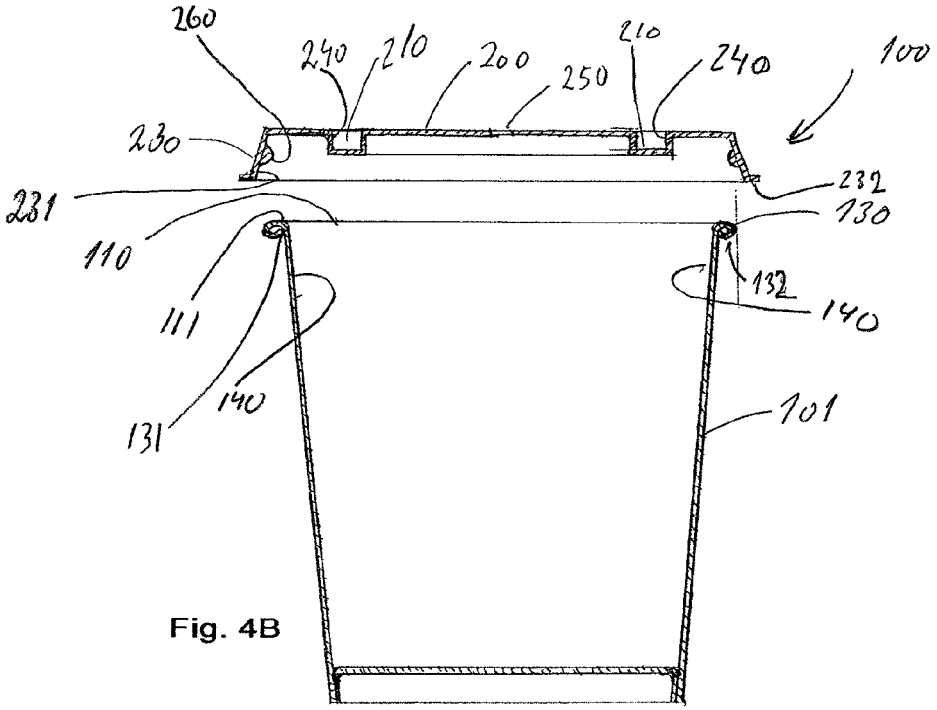
FIG. 4B shows a section through a food or beverage container and a lid as shown in FIG. 4A.
Figure 5A:
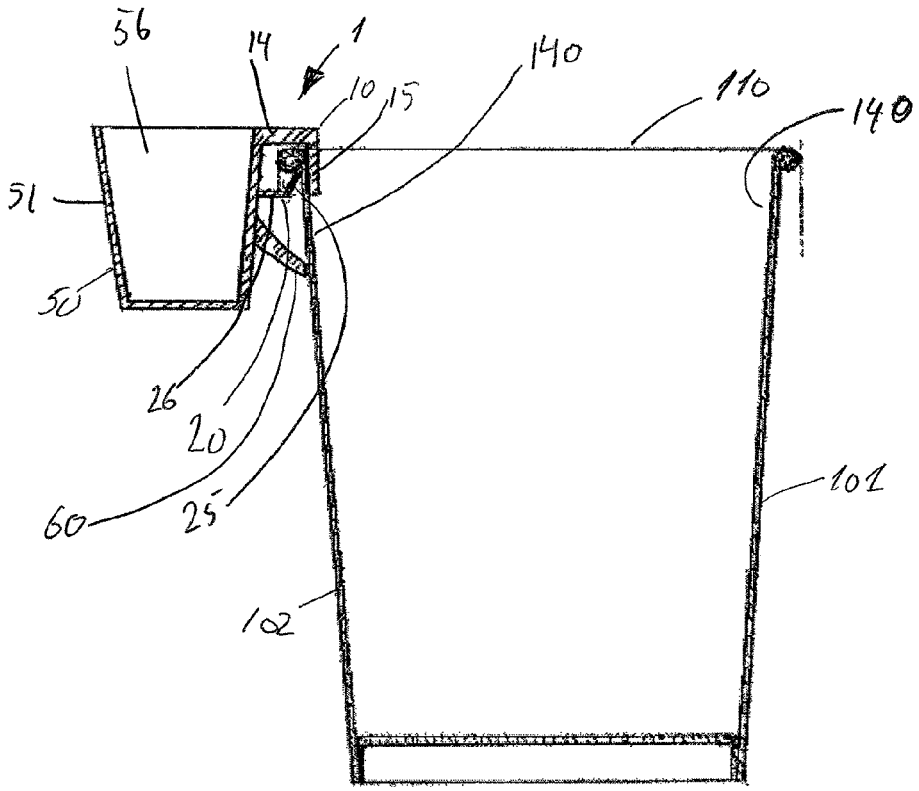
FIG. 5A, in a sectional view, shows a condiment container according to one embodiment of the invention attached to a food or beverage container as in FIGS. 4A and B, however without a lid.
Figure 5B:
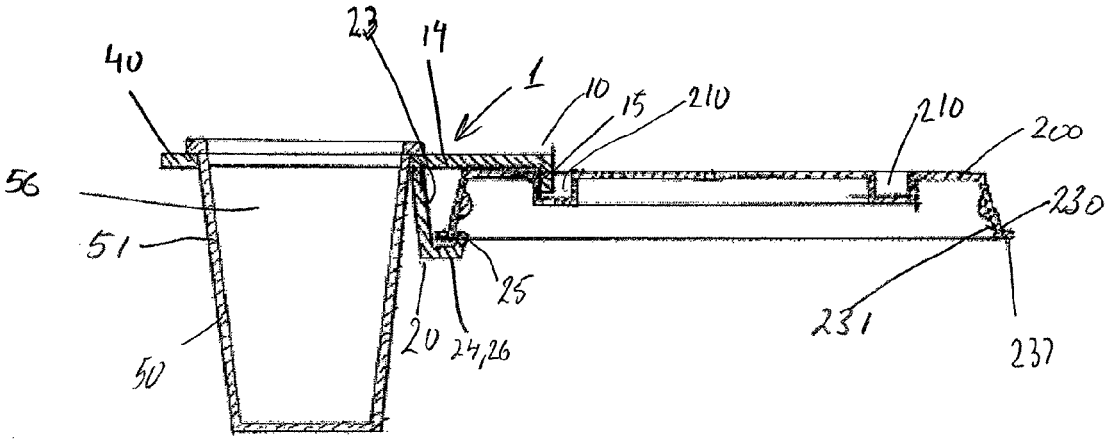
FIG. 5B, in a sectional view shows a condiment container attachment device according to another embodiment of the invention with a condiment container as attached to a lid of the food or beverage container as shown in FIGS. 4A and B.

The condiment container attachment device 1 according to principles of the present invention, however, is adapted to attach to food or beverage containers 100, 101, 200 of the type having an upwardly facing opening 110, at least one inwardly facing first surface 140, 240, and a bead 130 as shown in FIGS. 4 and 5, or a downwardly facing skirt encircling the opening 110. In FIGS. 4B and 5B the downwardly facing skirt 230 is formed on a lid 200, this lid being adapted for cooperating with bead 130 to close the container 100, e.g. by an inner bead 260 cooperating with bead 130 on container 101. However, a downwardly facing skirt may also be arranged on the container proper 101 at the rim or upwardly facing edge 111, in order to cooperate with a lid also having a skirt 230 or to function as a strengthening and/or rounding of the container 101 edge 111. The food or beverage container 100, 101, 200 has a sidewall having an inner surface 140, and storage space.

The bead 130 or skirt 230 further includes an inwardly facing second surface 131, 231 and a downwardly facing edge 132, 232.

The condiment container attachment device 1 includes first attachment means 10 adapted for engagement with said inwardly facing first surface 140, 240 of the food or beverage container 100. Thus the condiment container attachment device 1 is allowed to hang on the container 100. The condiment container attachment device 1 further comprises second attachment means 20 adapted for engagement with said bead 130 or downwardly facing skirt 230. Thereby, the condiment container attachment device 1 may be stably secured to the container 100. The second attachment means 20 are arranged to counteract a downward moment on said first attachment means 10.

The first attachment means 10 preferably, and as shown in the figures cooperate with the first surface 140, 240 by engagement between a downwardly facing tap 15 and said first surface 140, 240. An inwardly facing first arm 14 of the first attachment means 10 preferably connects the tap 15 with the condiment container attachment device 1, whereby the condiment container attachment device 1 is allowed to "hang" on the rim of the cup part or container proper 101 of the container 100 or the lid 200 of the container 100.

In the embodiment of the condiment container attachment device 1 exemplified in FIG. 5A the tap 15 of the first attachment means 10 cooperates with or engages the inner, first surface 140 of the food or beverage container 101.

In the embodiments shown in FIGS. 1-3, and 5B the tap 15 of the first attachment means 10 cooperates with or engages the inwardly facing first surface 240 provided in a lid 200 of the food or beverage container 101. Preferably, such inwardly facing first surface 240 may be provided in a groove 210 formed in the top surface of the lid. However, such inwardly facing first surface 240 may also be provided by other means, e.g. a collar or flange or taps (not shown) extending upwardly from the lid 200.

In the embodiments shown in FIGS. 1 and 2 a set of two inwardly facing arms 14 are provided. However in other embodiments (not shown) one or three may be provided.

In one embodiment, and as illustrated in FIG. 5A, the second attachment means 20 is provided as a tap 25, 26 adapted for engagement with said inwardly facing second surface 131 or said downwardly facing edge 132 of said bead 130 on the cup part or container proper 100, 101. In embodiments where the food or beverage container proper 101 has a downwardly facing skirt (not shown), the tap 25 shown in FIG. 5A may engage the inwardly facing surface thereof, in the same manner as is shown with the bead 130 in FIG. 5A.

Figure 3A:
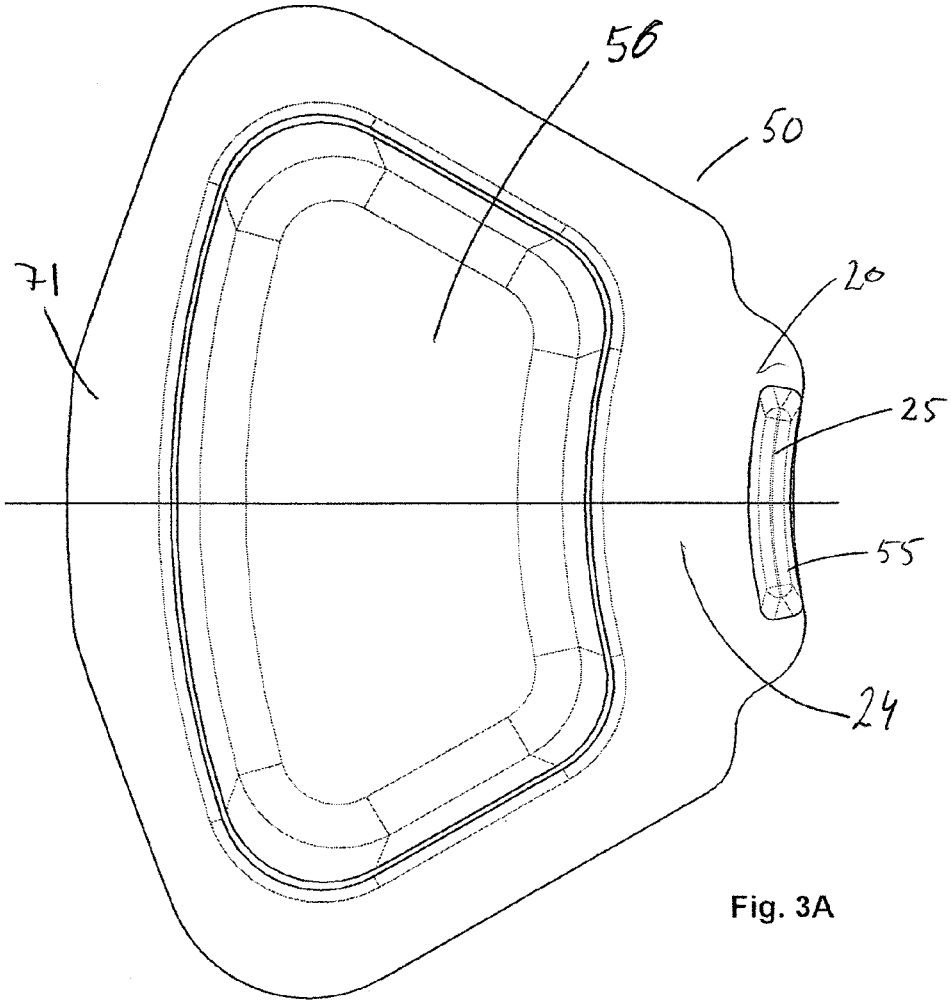
FIG. 3A, in a top view, shows a condiment container adapted for attachment to a beverage or food container with a condiment container attachment device as shown in FIG. 2.
Figure 3B:
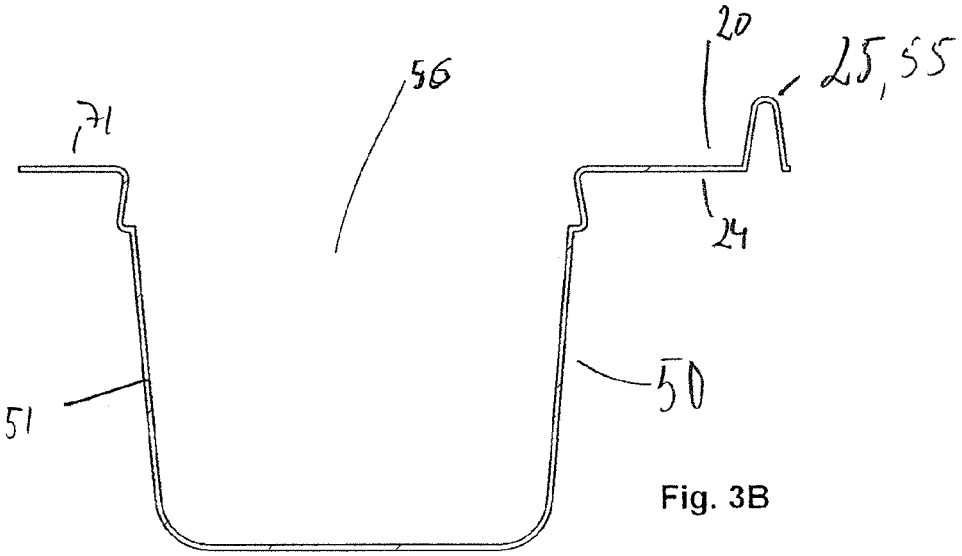
FIG. 3B is a sectional view of the condiment container shown in FIG. 3A Taken along section B-B.

In another embodiment, the inwardly facing second surface 231 and said downwardly facing edge 232 are formed on a downwardly facing peripheral skirt 230 on a lid 200 for the food or beverage container 100, 101. The second attachment 20 means may then include a tap 25, 26 adapted for engagement with said inwardly facing second surface 231 or the downwardly facing edge 232 downwardly facing skirt on the lid 200, as shown in FIG. 5B. The devices 1 shown in FIG. 1 and in FIGS. 2 and 3 are adapted for this purpose.

The condiment container attachment device 1 shown in the FIG. 5A and in FIG. 5B embodiments has second attachment means 20 formed by an upwardly facing tap 25 for engagement with said inwardly facing second surface 131, 231. The upwardly facing tap 25 is connected to the remainder of the condiment container attachment device 1 by an inwardly facing second arm 24 of the second attachment means 20.

The condiment container attachment device 1 shown in the FIG. 1 and in the FIGS. 2+3 embodiments has second attachment means 20 comprised by inwardly facing tap 26 for engagement with said downwardly facing edge 132, 232. The inwardly facing tap 26 is connected to the remainder of the condiment container attachment device 1 by an inwardly facing second arm 23 of the second attachment means 20.

In the embodiments shown in FIGS. 1, 2 and 5B, the condiment container attachment device 1 includes holding means 40 for receiving an attachable condiment container 50. The holding means 40 includes, preferably and as shown, a closed brace or loop, but may also be a fork or the like. The shape of the holding means 40 is preferably adapted to the shape of the condiment container 50. In the FIG. 1 embodiment, the holding means 40 is adapted for receiving a standard type box shaped condiment container 50 of the type having four sidewalls 51 and a detachable metalized lid attached to a rim at the top of the four sidewalls. This is schematically illustrated in FIG. 5B.

In the FIG. 1 embodiment, the holding means 40 is adapted such that rim of the attachable condiment container 50 may rest on the holding means 40. The condiment container attachment device 1 further includes snap means 70 for releasably fixing the condiment container 50, the snap means shown being downwardly facing taps, the taps being resilient to press on the sidewalls 51 of the likewise resilient condiment container 50.

In the FIG. 2 embodiment the holding means 40 are also in the shape of a loop or brace. The condiment container 50, shown in FIG. 3, is specially adapted. The condiment container 50 may again be formed with an upper rim resting on the holding means 40. A part of this rim is adapted as snap means 71 adapted to cooperate with snap means 60 on the holding means 40, and being provided as a brace part under which snap part 71 of the rim of the condiment container may be held. The FIGS. 2 and 3 embodiment is special in that the second attachment means are provided on the condiment container 50 (shown in FIG. 3. The second attachment means 20 adapted for engagement with said inwardly facing second surface 131, 231 is provided on an inwardly extending arm 24 formed integral with and extending from said releasable condiment container 50. In this case the upwardly facing tap 25 may be provided in the form of a bulge 55 provided on the inwardly extending arm 24 on said releasable condiment container 50.

However, and as shown in FIG. 5A the condiment container attachment device 1 and the condiment container 50 may be formed integral with each other.

As may be seen in FIGS. 1, 2, and 5A the condiment container attachment device 1 further may comprise a third arm 60 or set of arms adapted for engagement with an outer surface of said food or beverage container 100, In order to provide a fixed distance between the food or beverage container 100 and the condiment container attachment device 1, and to prevent downwards rotation of the condiment container attachment device 1 in order to further ensure the engagement of the first and second attachment means 10, 20.

As is apparent from FIG. 1 additional second attachment means 20 may be formed on said third arm 60, e.g. in the form of a notch 61 formed in said arm 60.

Although the present invention has been described in connection with the specified embodiments, it should not be construed as being in any way limited to the presented examples. The scope of the present invention is set out by the accompanying claim set.

The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A condiment container attachment system for a food or a beverage container, the food or beverage container having an upwardly facing opening, and the device comprising:

a lid sized and configured to cover the opening, said lid having an inwardly facing first surface and a downwardly facing skirt sized and arranged to encircle said opening, said skirt having an inwardly facing second surface and a downwardly facing edge; and a condiment container attachment device comprising a downwardly facing tap configured and arranged to engage said inwardly facing first surface of the lid;

a first arm configured and arranged to engage said inwardly facing second surface or said downwardly facing edge of said downwardly facing skirt, said first arm being vertically positioned below said downwardly facing tap; and a holder attached to the first arm and to the downwardly facing tap, the holder comprising an upwardly facing opening sized and configured to receive an attachable condiment container therein.

2. The condiment container attachment system according to claim 1, wherein said first arm is configured to counteract a moment on said downwardly facing tap.

3. The condiment container attachment system according to claim 1, further comprising:

an inwardly extending second arm, said downwardly facing tap extending from said second arm.

4. The condiment container attachment system according to claim 1, wherein said lid comprises a groove, and said inwardly facing first surface is formed in said groove.

5. The condiment container attachment system according to claim 1, wherein said first arm comprises a tap adapted for engagement with said inwardly facing second surface or with said downwardly facing edge of said downwardly facing skirt on said lid.

6. The condiment container attachment system according to claim 1, wherein said first arm comprises an upwardly facing tap for engagement with said inwardly facing second surface.

7. The condiment container attachment system according to claim 6, wherein said first arm comprises an inwardly facing third arm, said upwardly facing tap extending from said third arm.

8. The condiment container attachment system according to claim 1, wherein said first arm comprises an inwardly facing tap for engagement with said downwardly facing edge.

9. The condiment container attachment system according to claim 1, further comprising:

snap means for releasably fixing said condiment container to said holder.

10. The condiment container attachment system according to claim 1, wherein the holder comprises an upwardly facing loop.

* * * * *